United States Patent [19]

Kronseder

[11] 4,361,460

[45] Nov. 30, 1982

[54] LABELING DEVICE FOR BOTTLES AND THE LIKE

[76] Inventor: Hermann Kronseder, Regensburger Strasse 42, Worth/Donau, Fed. Rep. of Germany, 8404

[21] Appl. No.: 325,065

[22] Filed: Nov. 25, 1981

[30] Foreign Application Priority Data

Nov. 28, 1980 [DE] Fed. Rep. of Germany ..... 3044879

[51] Int. Cl.[3] ..... B65C 9/16; B65C 9/42

[52] U.S. Cl. ..... 156/568; 118/231; 156/364; 156/571; 156/DIG. 32; 156/DIG. 45; 271/33

[58] Field of Search ..... 156/364, 567, 568, 571, 156/DIG. 29, DIG. 32, DIG. 45; 271/33, 258; 118/220, 231

[56] References Cited

U.S. PATENT DOCUMENTS

| | | | |
|---|---|---|---|
| 4,092,206 | 5/1978 | Zodrow | 156/568 |
| 4,127,435 | 11/1978 | Zodrow | 156/568 |
| 4,279,687 | 7/1981 | Buchholz et al. | 156/571 |

FOREIGN PATENT DOCUMENTS

| | | | |
|---|---|---|---|
| 2411983 | 9/1975 | Fed. Rep. of Germany | 156/568 |

*Primary Examiner*—Michael G. Wityshyn

*Attorney, Agent, or Firm*—Ralph G. Hohenfeldt

[57] ABSTRACT

Labeling machine comprising a turret carrying plural pallets for periodically picking up glue, picking up a label on the glue, and transferring the glued label to a bottle or other workpiece by rotating the turret and oscillating the pallets radially inward and outward. Each pallet has a double-acting dog clutch for engaging or disengaging the drive which oscillates it; the clutch can be shifted only when the turret is at a particular angular position at which the pallet is sufficiently radially retracted to be clear of the sources of glue and labels and the mechanism for transferring labels. When a bottle is presented for receiving a label from a particular pallet the clutch is shifted to or maintained at its position for engaging the oscillating drive so the pallet transfers a glued label for application to the bottle. When no bottle is presented to be labelled by a pallet its clutch is shifted to or maintained at its position for disengaging the oscillating drive so the pallet is locked in a radially retracted position, clear of the source of labels and the mechanism for transferring labels to bottles. The machine is capable of labeling bottles very rapidly, and yet when a gap of even one bottle is detected in the feed stream labeling can be momentarily interrupted to prevent fouling the machine with superfluous labels.

12 Claims, 4 Drawing Figures

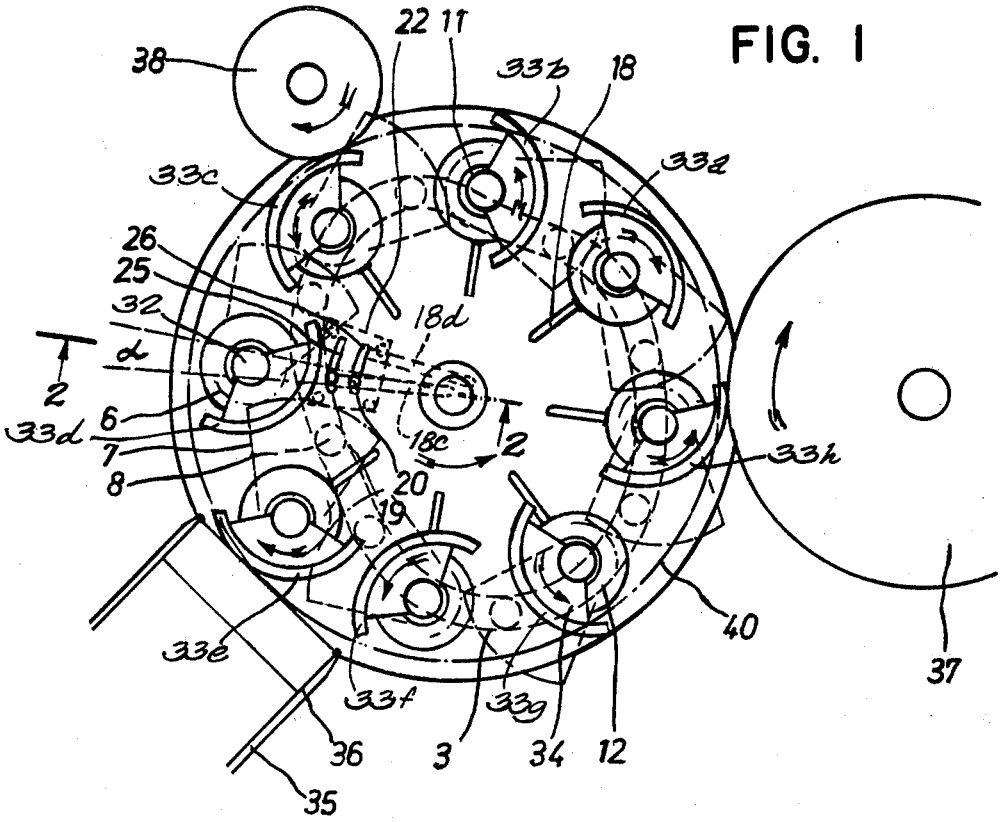
FIG. 1
FIG. 3
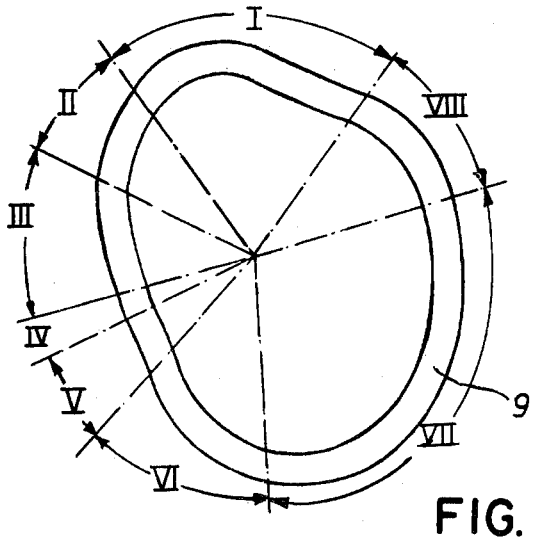
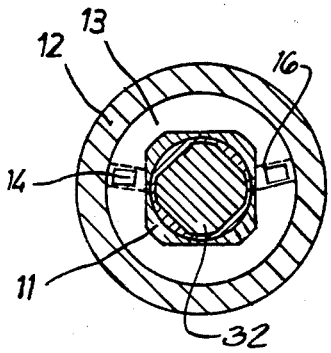
FIG. 4

LABELING DEVICE FOR BOTTLES AND THE LIKE

BACKGROUND OF THE INVENTION

The invention relates to an automatic labeling apparatus of the type in which several pallets are carried by a turret. The turret is rotated to successively bring each pallet in contact with a glue roller, source of labels, and transfer cylinder to pick up a charge of glue, adhere a label to the charge of glue, and transfer the glued label to a bottle or other workpiece to be labeled. The known labeling apparatus applies labels quickly, accurately, and reliably, and is therefore widely used to label bottles or the like in medium to large quantities.

One problem in the art of labeling is the need to momentarily interrupt the picking up and delivery of labels when no bottles are presented for labeling. First, label pickup must start or stop in synchronization with the supply of bottles to be labeled. Second, when short gaps appear in the bottle feed, even a gap of just one bottle, the pickup of labels and glue should be stopped to avoid fouling the labeling machine with superfluous labels.

In known labeling machines label pickup is momentarily interrupted by shifting the label magazine radially outward from the turret to prevent the pallets from reaching the labels in the magazine. When operated at a high rate of label delivery, for example at approximately 70,000 bottles per hour, known magazines cannot be removed and returned rapidly enough to prevent the delivery of just one label. The prior art labeling machines can omit a single label only by being operated at a reduced rate of speed, because in prior machines large masses must be moved to retract and return the label magazine. Finally, in prior art machines the possible acceleration of the label magazine to retract or return it is limited by the need to avoid throwing labels from the label magazine.

Another known means for momentarily preventing the pickup and delivery of labels (shown in German Laid Open Specification No. 24 11 983) requires a movable section in the cam track for guiding the radial travel of each pallet. The movable section is oscillated to periodically press the glue covered surface of a pallet against the foremost label in the label magazine. If the pickup of a label is to be prevented, then the cam track section remains radially retracted to prevent the pallets from contacting the labels in the magazine. The drive for oscillating the pallets about their eccentric axes is separate, and the thrust of the oscillating means must be taken up by a spring when the cam track is locked in its retracted position. This known labeling apparatus, on account of the independent oscillating drive and the spring in the cam track section drive, is not adapted to momentarily interrupt and resume high speed label pickup and delivery.

Another defect in each prior machine is the need to complete the changeover to interrupt or resume labeling during a small fraction of a revolution of the turret if more than one pallet is carried on the turret.

SUMMARY OF THE INVENTION

The object of the present invention is a high speed labeling machine which can be momentarily prevented from picking up one or more labels responsive to gaps in the feed of workpieces to be labeled. Another object of the invention is to provide a mechanism in which only a small mass must be displaced to interrupt or resume label pickup.

These objects are met by inserting a double-acting clutch between each pallet shaft and the corresponding driven shaft of the oscillating drive for the pallet. In one position the clutch positively engages the pallet shaft and driven shaft for periodically oscillating the pallet from a radially retracted position to a radially extended position for successively contacting the source of glue, label source, and label transfer cylinder. In its other position the clutch disengages the driven shaft and pallet shaft and locks the pallet shaft to a frame member of the turret, retaining the pallet in its retracted position to prevent pickup and delivery of labels and glue. The clutch can be shifted from either position to the other only at an angular position of the turret in which the pallet is normally momentarily retracted and motionless with respect to the turret, so only an element of the clutch must be accelerated and decelerated to interrupt or resume the label pickup and delivery cycle. The movable element can have a very low mass and can thus be shifted quickly by applying a small force.

The double acting clutch is preferably a dog clutch to positively lock the engaged members together. The dog clutch does not interfere with the operation of any moving part other than the specific pallet with which it is associated, and it positively engages between the driven shaft and pallet shaft during normal labeling so removal and delivery of the labels during normal operation of the machine progresses with the usual high output and safety in operation.

For any labeling machine, but particularly for labeling machines in which multiple pallets are carried on a single turret, the present clutch mechanism can shift during a substantially longer period of time than is available for shifting the entire label magazine or cam track in prior machines. The clutch for an individual pallet can be shifted during the period after the pallet delivers a label to the label transfer cylinder and before the pallet arrives at the stack of labels. Less than all of the pallets can be affected, depending on the size of the gap in the bottle feed, and each is shifted individually. Therefore, momentary interruption and resumption of label removal is possible at rates of output previously considered impossible.

In some labeling machines the normal travel of the pallets between the pickup cylinder and label magazine includes a portion in which the pallets are retracted radially inwardly. Such machines can be modified in accordance with the invention without changing the gearing for the pallet drive. In other machines the gearing connected in series with the drive member can be constructed so that each pallet is retracted radially inwardly and momentarily brought to a standstill with respect to the turret just before it is presented to the label magazine. The drive can then be disengaged and the pallet locked in its retracted position in this position of the pallet drive to interrupt labeling.

The coupling and uncoupling of each clutch takes place at a single point, and an individual clutch is therefore engaged and disengaged at only one angular position of the turret corresponding to a particular position in the labeling cycle. The pallet therefore remains in synchronization. For most labeling apparatus, the invention also prevents the pallet from contacting the label transfer cylinder and the glue roller when labeling is interrupted, so that neither the pallet nor the label transfer cylinder is fouled with excess glue or labels when no bottle is presented to receive a label.

Preferably the actuating member for the clutch is a double acting fluid pressure cylinder within which the moving element of the clutch acts as a piston. The moving element of the clutch is thus contained within a compact, closed structural unit and can be lubricated advantageously by adding oil to the compressed air for moving the clutch element. This arrangement also permits the charge of air for shifting the clutch to be applied before the clutch reaches the angular position at which it is capable of being shifted. When the angular position for shifting is attained, shifting can immediately take place, and reshifting cannot occur until the clutch returns to the angular position at which the previous shift took place.

The clutch can also be biased toward a condition in which the drive is engaged, allowing the labeling apparatus to be operated even if the fluid pressure for operating the clutch fails.

Other features and advantages of the preferred embodiment of the invention will become evident from the description which follows.

BRIEF DESCRIPTION OF DRAWINGS

FIG. 1 is a simplified plan view of the labeling apparatus with its cover plate removed.

FIG. 3 is a transverse cross-section taken along line 3—3 of FIG. 2.

FIG. 4 is a plan view of the cam track which directs the oscillations of the pallets.

DETAILED DESCRIPTION OF THE PREFERRED EMBODIMENT

Figure 2:
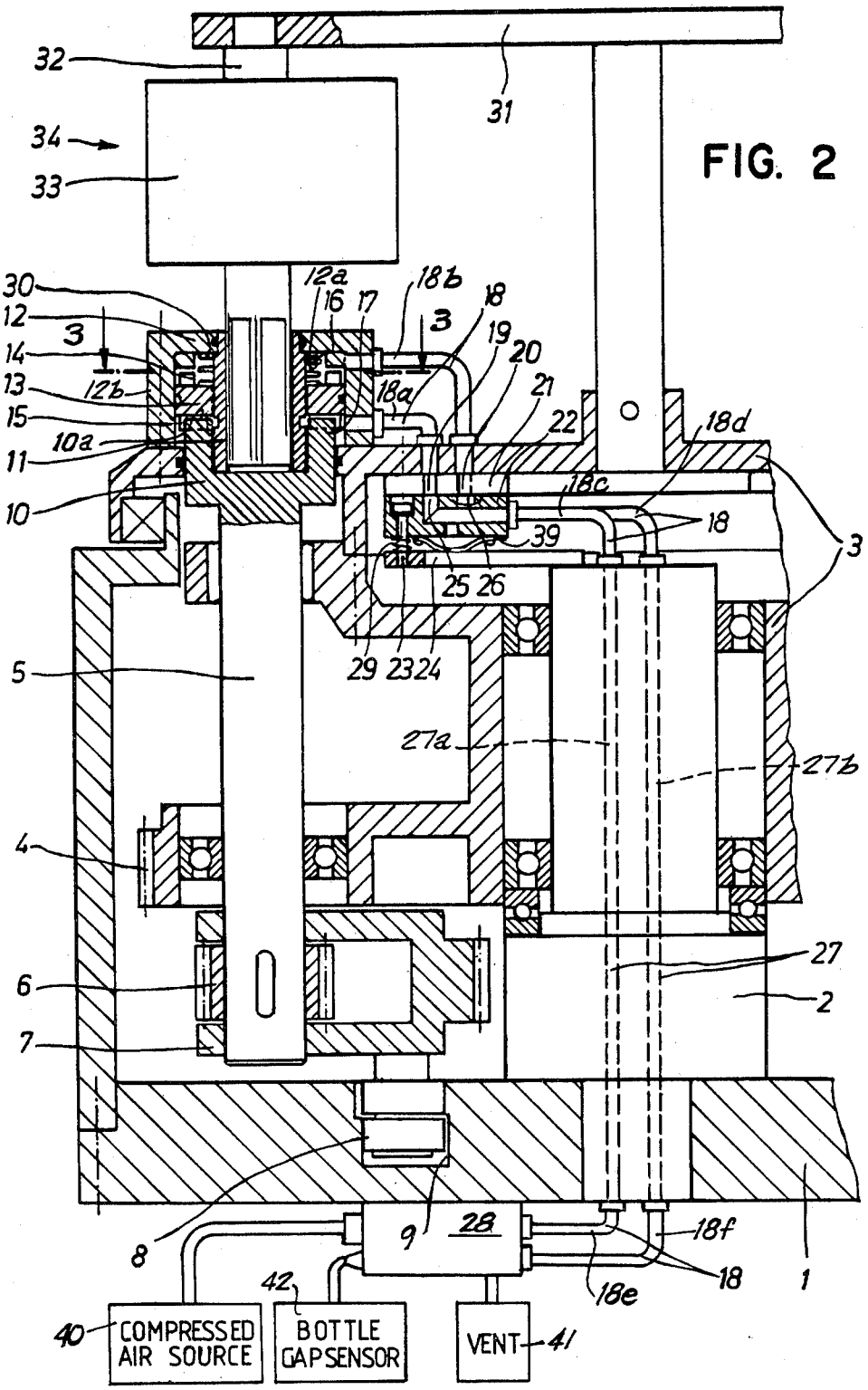
FIG. 2 is a radial cross-section taken along line 2—2 of FIG. 1.

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

The labeling apparatus has a stationary turret support 1 with a vertical shaft 2 on which a turret 3 is rotatably positioned. The periphery of turret 3 is formed as a gear 4, by which it is continuously driven counterclockwise. The turret carries eight circumferentially spaced shafts 5, each rotatably supported on an eccentric axis parallel to shaft 2. A pallet shaft 32 is coaxial with and normally driven by each shaft 5; each pallet shaft 32 has a pallet 33 keyed to it for picking up and delivering glue and labels. A gear wheel 6 is keyed to the lower end of each shaft 5, and a segment gear 7 is mounted on each shaft 5 for free rotation thereon. The toothed arcuate perimeter of each segment gear meshes with the gear wheel 6 on the following shaft 5 (best seen in FIG. 1). Guide rollers 8 are carried on the underside of each segment gear 7 to engage a cam track 9 fixed to turret support 1.

Referring now to FIGS. 1 and 4, guide rollers 8 positioned in cam track 9 and fixed to segment gear 7 oscillate the segment gears 7, and thus oscillate each shaft 5 about its axis as turret 3 revolves. When rollers 8 move radially inward the corresponding shaft 5 rotates counterclockwise, turning eccentrically mounted pallet 33 radially inward of an imaginary circle 40 and increasing the peripheral velocity of pallet 33. Conversely, when rollers 8 move radially outward shaft 5 and pallet 33 rotate clockwise, and the pallet passes outside of circle 40. At this time the peripheral velocity of the pallet is reduced because the turret and eccentric shaft are rotating in opposite directions.

The resulting motion of each pallet during normal labeling is as follows. Each pallet is unloaded when in the position of pallet **33*a* (FIG. 1) having just given up a glued label to label transfer cylinder 37. Sector I of cam track 9 is then engaged by the roller of pallet 33*a*, moving the pallet radially outward by rotating it clockwise on its pallet shaft as turret 3 turns. When the pallet reaches the position of pallet 33*b* its guide roller enters sector II of the cam track, which decreases in radius as the pallet shifts in position to the location of pallet 33*c*. The pallet then rotates counterclockwise, increasing its peripheral velocity to quickly sweep the pallet across a glue roller 38**, thereby charging the pallet with glue.

Once the pallet has picked up a layer of glue its guide roller 8 enters sector III of the cam track, in which the roller is drawn radially inward to fully retract the pallet. When the guide roller enters sector IV the cam track is of minimum and constant radius so the pallet, now at the position of pallet **33*d*, temporarily ceases its eccentric rotation and is retracted radially inward of circle 40. The pallet, when retracted as at 33*d*, is not in a position to contact the glue roller 38, labels 36, or label transfer cylinder 37**.

When the guide roller enters sector V and continues through sector VI of the cam track, at which time the pallet is in the position of pallet **33*e*, the increasing radius of the track swings the pallet clockwise and radially outward so the clockwise eccentric rotation of the pallet and counterclockwise rotation of the turret cancel, producing a peripheral velocity for the pallet of about zero. As a result the periphery of the pallet in position 33*e*** rolls across the top label without imparting a substantial shearing motion to the label. Since glue has previously been applied to the pallet the label adheres to it and a single label is thereby detached from the labels in the magazine.

Finally, when the pallet passes through the positions of pallets **33*f*, 33*g*, and 33*h* the guide roller is passing through sector VII which has a gradually increasing radius, so the pallet is rotated counterclockwise on its shaft, accelerating the glued label to a greater peripheral velocity than that of the turret alone. The label and glue are then transferred to transfer cylinder 37 which is rotated at the same peripheral velocity as the periphery of the pallet to receive the label and detach it from the pallet without imparting a substantial shear to the label. The pallet is then returned to the position of pallet 33*a*** to start a new, identical cycle of picking up glue, picking up a label on the glue, and transferring the glue and label to the transfer cylinder for application to a bottle or other workpiece.

Now the means for momentarily interrupting the labeling cycle will be described. Referring now to FIG. 2, an upright cup-shaped member 10 at the upper end of each shaft 5 has a cylindrical bore which receives the lower end of a collar 11 for relative rotation. The bore of each collar 11 has a polygonally shaped cross-section and is splined to the correspondingly profiled end of a pallet shaft 32 coaxial with shaft 5 and keyed to pallet 33.

Each member 10 has a transversely disposed annular upper surface **10*a*. An inverted cup-shaped member 12 fixed to turret 3 corresponds to each member 10 and has an annular plate member defining a second transversely disposed surface 12***a* coaxial with a shaft 5. A skirt depending downwardly from surface 12*a* defines a cylindrical wall 12*b*. Surfaces 10*a* and 12*a*, cylindrical wall 12*b*, and collar 11 define an annular pneumatic cylinder. The upper end of each collar 11 is guided rotatably by the wall of a coaxial bore through the annular base of the corresponding cup 12. The interior of each pneumatic cylinder is isolated from the ambient air by several packings.

A transversely disposed floating annular clutch plate 13 splined to the polygonal midsection (FIG. 3) of collar 11 is axially slidable in the middle area of collar 11. Clutch plate 13 has packings on its internal and external walls, and thus is a double-acting piston dividing the interior of the annular pneumatic cylinder into two partial chambers of variable size.

At least one, and preferably two or more radially extending teeth 14, 15 are disposed assymetrically (see FIG. 3) on each major face of the clutch plate 13. First and second surfaces 10*a* and 12*a* have radially extending grooves 16, 17 which can receive the adjacent teeth 14 or 15 to positively lock plate 13 to either surface. A double-acting dog clutch is thus defined in which plate 13 can shift axially between a first position for engaging surface 10*a* and a second position for engaging surface 12*a*. The teeth 14, 15 and grooves 16, 17 are so arranged that clutch plate 13 can shift from one axial position to the other only when the relative position of the turret 3, collar 11 and shaft 5 is as shown in FIG. 2 (see pallet 33*d* in FIG. 1). If clutch plate 13 assumes its upper position the teeth 14 of its upper or second side engage in the grooves 16, whereby collar 11 is locked to turret 3, and accordingly cannot rotate with respect to the turret. If the clutch plate assumes its lower position, then teeth 15 of its lower or first side engage grooves 17, whereby the collar 11 is locked to shaft 5, and thus is driven by the drive for shaft 5 as previously described. The axial positions of teeth 14 and 15 and the spacing between surfaces 10*a* and 12*a* are such that when clutch plate 13 is between its axial extremities of travel it momentarily engages the grooves in both surfaces to ensure circumferential alignment of clutch plate 13 and surfaces 10*a* and 12*a* during shifting.

A relatively weak compression spring 30 can be installed between clutch plate 13 and surface 12*a* so that the clutch plate 13 will normally press downwardly to maintain the engagement between collar 11 and shaft 5.

In this embodiment each clutch plate 13 is shifted axially by venting the corresponding chamber on one side of plate 13 and charging the chamber on the other side of plate 13 with compressed air. To accomplish this, the two partial chambers of each pressure cylinder are connected by means of conduits 18*a* and 18*b* with a pair of radially spaced slide ports 19, 20 of a slide ring 21 fixed concentrically to turret 3 and perpendicularly to its axis of rotation. The slide ports 20 communicating with the upper partial chambers of the several cylinders are circumferentially spaced at a first radius of slide ring 21, and the slide ports 19 leading to the lower partial chambers are circumferentially spaced at a second radius of slide ring 21. A slide shoe 22 is held adjacent slide ring 21 and guided by several adjustment bolts 23 threaded to a stationary holding arm 24 fixed on shaft 2. Slide shoe 22 has a sliding surface on its upper side, including shoe ports 25 and 26, one positioned at the same radius as each slide port 20 and the other positioned at the same radius as each slide port 19. Only one slide shoe 22 is required for the entire machine. Thus, when one pair of slide ports 19 and 20 and shoe ports 25 and 26 are in registration the stationary and moving ends of conduits 18 communicate. Shoe ports 25 and 26, which may be arcuate slots, are connected through bores in the slide shoe 22, conduits 18*c* and 18*d*, passages 27*a* and 27*b*, and conduits 18*e* and 18*f* with an electromagnetically actuated control valve 28 seated on the under side of turret support 1. The valve is also attached to a source 40 of compressed air and a vent 41 as well as to a bottle gap sensor 42 associated with the feed steam of bottles to be labeled.

The slide shoe 22 bears on the slide ring 21 due to compression springs 29 carried on bolts 23 and inserted between slide shoe 22 and holding arm 24. Inflatable members 39 (such as bellows or compressed air cylinders) positioned between slide shoe 22 and holding arm 24 are connected with shoe port 25 so that the compressed air supplied by the pneumatic cylinder inflates member 39, causing slide shoe 22 to bear more firmly against slide ring 21 when plate 13 is moved against the bias of spring 30.

As is apparent from FIG. 1, the two ports 25, 26 in the slide shoe 22 are circumferentially extending slots which first communicate with slide ports 19 and 20 before the turret 3 has reached the angular position in which a pallet 33 is fully retracted. The charge of compressed air can thus act on the clutch plate 13 before and during the time when the clutch plate can shift from one position to the other; such shifting is only possible when the pallet is in the position of pallet 33*d*. The exact shifting point is accordingly determined not by the compressed air control but by the configuration of the dog clutch and the angular position of the turret.

If bottle gap sensor 42 detects a gapless bottle feed, control valve 28 introduces a charge of air from the compressed air source, via conduit 18*f*, passage 27*b*, conduit 18*d*, port 26, port 20, and conduit 18*b*, to the space between clutch plate 13 and surface 12*a*. At the same time, the space between plate 13 and surface 10*a* is vented via conduit 18*a*, ports 19 and 25, conduit 18*c*, passage 27*a* and conduit 18*e*. The control valve 28 remains in this position as long as labeling is desired, but air is delivered to and vented from the pneumatic cylinder only when the corresponding ports of the slide ring 21 and slide shoe 22 are aligned.

If the clutch plate 13 is already in its lower position, the compressed air feed has no effect at all and the pallet 33 is driven oscillatingly as described previously. If the clutch plate 13 has previously been in its upper position engaging surface 12*a* and the flow of bottles has now resumed, then it is urged downward by the charge of compressed air, and slides axially downward when the grooves 17 in surface 10*a* line up with teeth 15. Teeth 15 enter slots 17 as teeth 14 leave slots 16. The pallet 33 then is driven oscillatingly by its drive member 11. The shoe ports 25 and 26 do not extend beyond the shifting region ($\alpha$), so after shifting is completed the chambers of the pneumatic cylinder are disconnected from source 40 and vent 41.

If the bottle sensor signals a gap in the bottle feed or the end of the bottle supply, then just before a label is picked up by the pallet 33 which would place a label on the first missing bottle valve 28 reverses, now charging compressed air into the space between plate 13 and surface 10*a* and venting the space between plate 13 and surface 12*a*. When the pallet shaft 32 of that pallet reaches region $\alpha$, in which teeth 15 and slots 17 of the dog clutch line up, clutch plate 13 is shifted to disengage surface 10*a* and engage surface 12*a*. The pertaining pallet 33 is now locked in its retracted position within the periphery of circle 40, so that the pallet cannot contact the labels 36, transfer cylinder 37 or glue roller 38 for at least one revolution of the turret. If only one or a few bottles are missing from the feed, only the particular pallets which would deliver labels to the missing bottles are sequentially disabled, and the others remain in operation. If many successive gaps are present, as when no bottles are being fed, the pallets will all be locked in their retracted positions until feeding continues, at which time each will be unlocked in turn to resume picking up a label, delivering it, and picking up a charge of glue.

I claim:

1. In a labeling machine comprising a turret rotatably mounted on a stationary turret support; a source of glue, a source of labels, and a label transfer cylinder, each positioned adjacent said turret; at least one pallet mounted to said turret for rotation about an eccentric axis; and drive means to periodically oscillate each said pallet about said eccentric axis between a radially retracted position for clearing said glue roller, label source, and label transfer cylinder and a radially extended position for successively contacting said source of glue, removing a label from said label source, and transferring said glue and label to said label transfer cylinder;

a double-acting clutch for momentarily disengaging said drive means from one said pallet and locking said pallet in said radially retracted position, comprising:

first and second coaxial shafts aligned on said eccentric axis, said first shaft having a first end keyed to said pallet, said second shaft having a first end driven by said drive means, and said shafts having adjacent second ends;

a first transversely disposed surface formed by a member fixed to the second end of said second shaft and coaxial therewith;

a second transversely disposed surface formed by a member fixed to said turret support and axially spaced from said first surface;

a transversely disposed floating clutch plate slidably splined on the second end of said first shaft for axial travel between said first and second surfaces, said clutch plate having a first side for engaging said first surface and a second side for engaging said second surface;

pallet locking means to momentarily disengage said first side and said first surface and engage said second side and second surface while said pallet is in said retracted position, for locking said pallet in said retracted position; and pallet drive engaging means to engage said first side and said first surface and disengage said second side and said second surface for oscillating said pallet.

2. The labeling machine of claim 1, wherein said double-acting clutch is a dog clutch.

3. The labeling machine of claim 2, wherein said clutch plate can shift between engagement with said first surface and engagement with said second surface only when said pallet is in said retracted position and said turret is at a particular angular position.

4. The labeling machine of claim 3, wherein said particular angular position is between the position at which said pallet normally accepts glue from said source of glue and the position at which said pallet normally accepts a label from said source of labels.

5. The labeling machine of claim 3, wherein said pallet locking and pallet drive engaging means are actuated just before said turret arrives at said particular angular position.

6. The labeling machine of claim 3, wherein said clutch plate has a first axial position at which it only engages said first surface, a second axial position at which it only engages said second surface, and a third, intermediate axial position at which said clutch plate instantaneously engages both surfaces during travel of said clutch plate between said first and second positions.

7. The labeling machine of claim 1, wherein a cylindrical wall extends between said first and second surfaces to define a closed cylinder, said clutch plate is annular and has inner and outer packings for sealingly engaging said second shaft and said cylindrical wall to define a piston carried within said cylinder, said locking means comprises means for introducing a pressurized fluid into said cylinder between said clutch plate and said first surface while venting the space in said cylinder between said clutch plate and said second surface, and said pallet drive engaging means comprises means for introducing a pressurized fluid into said cylinder between said clutch plate and said second surface while venting the space in said cylinder between said clutch plate and said first surface.

8. The labeling machine of claim 7, further comprising first and second conduits having first and second ends, said first conduit first end communicating with the interior of said cylinder adjacent said first surface, said second conduit first end communicating with the interior of said cylinder adjacent said second surface, and the second ends of said conduits communicating with pressure regulating means comprising a source of fluid under pressure, a vent, and valve means for connecting a selected one of said second ends with said source of fluid and the other of said second ends with said vent.

9. The labeling machine of claim 8, wherein said first ends are secured to a moving element carried on said turret, said second ends are secured to said stationary turret support, and a rotating seal is provided for bringing the first and second ends of the respective conduits into communication during a selected portion of the rotation of said turret for causing axial travel of said clutch plate.

10. The labeling machine of claim 9, wherein said rotating seal comprises a slide ring concentric with and attached to said turret, a slide shoe adjacent said slide ring and mounted to said stationary turret support, said slide ring including first and second radially separated circumferentially disposed slide ports respectively communicating with the first ends of said first and second conduits, said slide shoe including first and second radially spaced shoe ports communicating with the respective second ends of said conduits, whereby to permit communication between said first and second ends when said slide ports and shoe ports communicate during a segment of the circumferential travel of said turret.

11. The labeling machine of claim 10, wherein said slide shoe is interposed between said slide ring and a frame member fixed to said stationary turret support, an inflatable member is disposed between said slide shoe and frame member, and means are provided for communicating between at least one of said conduits and the interior of said inflatable member to inflate it, thereby urging said slide shoe against said slide ring in sealing relation when at least one conduit is charged with pressurized fluid.

12. The labeling machine of claim 1, wherein said second end of said first shaft comprises a collar splined to said first shaft and having a non-round outer mid-section for splining said clutch plate to said collar.

* * * * *